United States Patent [19]

Wear et al.

[11] Patent Number: 4,899,974

[45] Date of Patent: Feb. 13, 1990

[54] DISPLAY CLIP STRUCTURE

[75] Inventors: Philip A. Wear, Minnetonka; Stuart C. W. Wear, Minneapolis, both of Minn.

[73] Assignee: Popco Inc., Eden Prairie, Minn.

[21] Appl. No.: 353,537

[22] Filed: May 18, 1989

[51] Int. Cl.[4] ..... A47F 7/14

[52] U.S. Cl. ..... 248/467; 24/67.11; 211/45; 211/89

[58] Field of Search ..... 248/467, 470, 473, 488, 248/460; 24/67.11, 545, 563; 211/89, 45, 46

[56] References Cited

U.S. PATENT DOCUMENTS

| | | | |
|---|---|---|---|
| 3,023,474 | 3/1962 | Shears | 24/67.11 X |
| 3,350,045 | 10/1967 | Mayers | 248/467 X |
| 3,600,764 | 8/1971 | Froehlich, Jr. | 24/545 |
| 3,808,710 | 5/1974 | Ackerman et al. | 211/45 X |
| 4,105,127 | 8/1978 | Höll | 211/89 X |
| 4,629,075 | 12/1986 | Hutten | 211/45 X |
| 4,671,480 | 6/1987 | Frye | 248/467 X |
| 4,773,545 | 9/1988 | Jones | 211/45 X |

*Primary Examiner*—Ramon O. Ramirez
*Attorney, Agent, or Firm*—Leo Gregory

[57] ABSTRACT

This invention relates to an extruded self-gripping clip poster hanger device consisting of an elongated body portion having a rail or track formed in its upper end portion and having an apertured ear or holder slidable in the rail, the body portion having a flat rear wall and a front wall arcuate in vertical cross section having a bottom lip in gripping engagement with the adjacent facing portion of the rear wall, the bottom lip and facing portion having engaging longitudinal ribs.

3 Claims, 1 Drawing Sheet

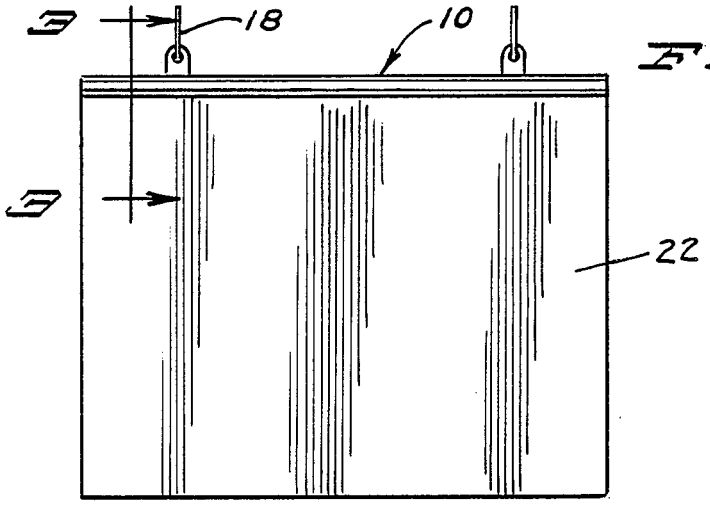
FIG. 1
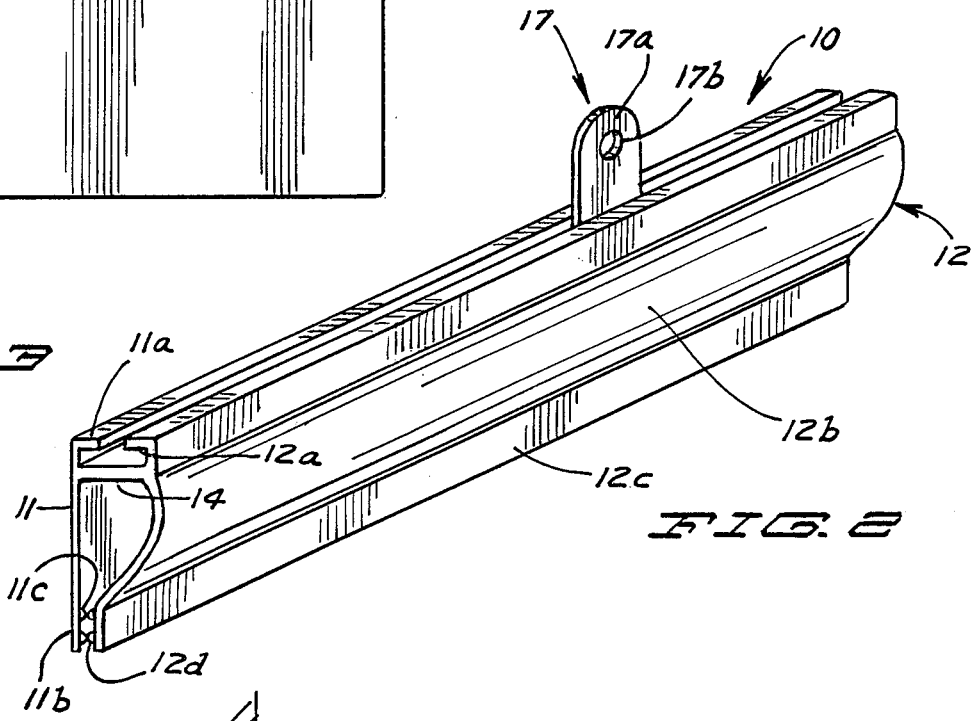
FIG. 2
FIG. 3
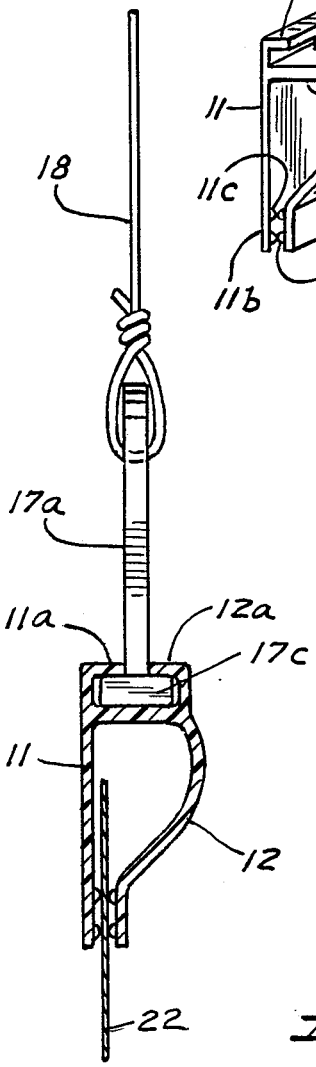
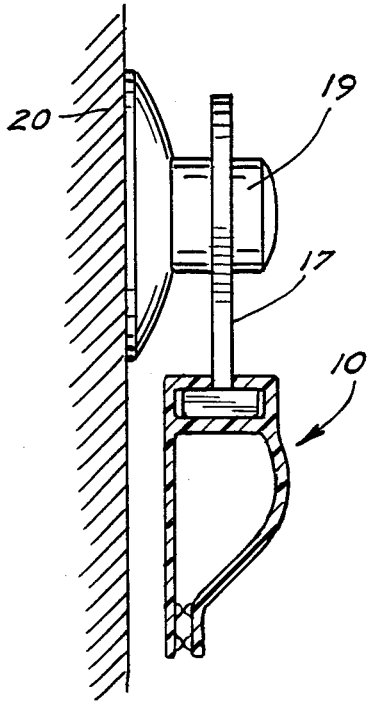
FIG. 4
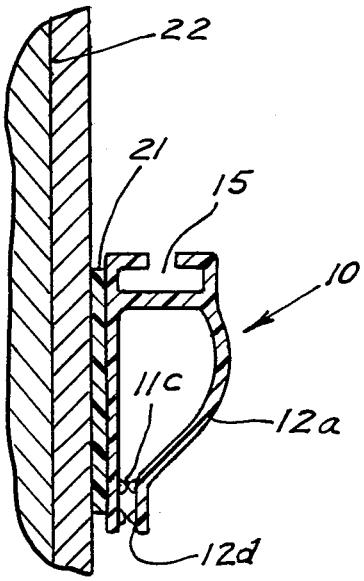
FIG. 5

DISPLAY CLIP STRUCTURE

BACKGROUND OF THE INVENTION

1. Field of Invention

This invention relates to a clip display hanger.

2. Brief Description of the Prior Art

There are in common use spring loaded clip members comprising a pair of facing plate members in combination with a spring urging the plate members into gripping engagement separable by pressing together a pair of upwardly angled ear-like lever members.

It is desirable to have a unitary clip member or hanger having a pair of separable engaging plate-like portions or lips which yield to separation under the pressure of a poster being inserted therebetween to be held thereby.

SUMMARY OF THE INVENTION

This invention comprises a hanger or clip member or device formed or extruded of a resilient material such as of a suitable plastic material and consisting of a track or rail formed in its upper edge portion, having a flat back wall and an outwardly curved front wall in cross section, said walls converging into a gripping engagement at their facing lower edge portions yielding for separation under the pressure of the insertion of a sign or poster to be held therebetween and a holder such as an apertured ear is slidably disposed onto said rail.

It is an object of this invention therefore to provide a simplified and effective unitary spring like poster holding device.

This and other objects and advantages of the invention will be set forth in the following description made in connection with the accompanying drawings in which like reference characters refer to similar parts throughout the several views.

DESCRIPTION OF THE DRAWINGS

FIG. 1 is a front elevational view showing the invention in operating position; and FIG. 2 is an enlarged view in perspective; and FIG. 3 is an enlarged view in vertical section on line 3—3 of FIG. 1 as indicated; and FIGS. 4 and 5 are views similar to that of FIG. 3 showing other operating positions.

DESCRIPTION OF A PREFERRED EMBODIMENT

With reference to the drawings and particularly as shown in FIG. 2, the invention herein comprising a sign or poster holding device is well shown in perspective and is indicated generally by the reference numeral 10.

Said holding device may be formed of any suitable resilient material which may be formed as by molding or more preferably by extrusion. Various plastic materials are well adapted for use in forming this device.

Referring again to FIG. 2, said device is here shown having a straight flat back or rear wall 11 and a front wall 12. Said walls in the present embodiment are shown to have facing right angled upper edge portions 11*a* and 12*a* spaced somewhat apart and having therebelow and extending between said front and back walls integral therewith is a horizontal underlying wall 14 forming in combination with said inward angled upper edge portions an upper rail or track 15.

Said front wall from the point of engagement therewith of said horizontal wall 14 is shown having a bulging outward downward and inward curvature as at 12*b* terminating in a bottom vertical flange portion or strip 12*c* which is parallel with an opposing lower edge portion 11*a* and the same have a natural normally resilient and yielding gripping engagement. The curvature of said front wall enhances its gripping action.

Said bottom edge portions 11*b* and 12*c*, which may be referred to as jaws, have formed thereon opposing longitudinal ribs 11*c* and 12*d* to enhance the gripping action between the jaws. Said ribs may have edge to edge engagement or be in an offset arrangement.

Slidably disposed into said rail is an ear-like hanging member or tab 17 having or flat upstanding ear-like portion 17*a* having an aperture 17*b* therethrough. The base 17*c* thereof as indicated in FIGS. 3 and 4 is rectangular in cross section and of a size to be readily disposable onto and slidable along said rail.

As indicated in FIGS. 1 and 3, said hanger 10 may be secured in an operating position by being hung as from a cord 18.

Said hanger 10 which has wide general use is very convenient for use as in a super market to be secured to the leading edge of a shelf to indicate the price of a product and also to highlight and draw attention to a new product.

Thus in FIG. 4, a knob or peg 19 is shown projecting as from a shelf edge 20 and extending through the aperature 17*b* to hold in suspended position said hanger or device 10. In FIG. 5 a self adhesive interface 21, which is in common use, is shown removably supporting or holding said hanger 10 onto a wall surface 22.

Referring now to FIGS. 1 and 3, a sign 22 is shown held secured between the jaws 10*a* and 12*c*. If said sign is somewhat rigid, an edge portion of it may be forcibly inserted between said jaws to separate the same sufficiently to position the sign therebetween. Said jaws have a very effective inter-gripping engagement.

The hanger 10 has instantly become a very well received item with remarkable initial sales.

It will of course be understood that various changes may be made in the form, details, arrangement and proportions of the product without departing from the scope of the invention which, generally stated, consists in a product capable of carrying out the objects above set forth, in the parts and combination of parts disclosed and defined in the appended claims.

What is claimed is:

1. a self-gripping poster holder formed as a resilient unitary body clip structure comprising a back wall and a front wall in closed spaced relation, an upper portion of each of said walls being angled to have facing edges, a plate member horizontally disposed below said upper portions and being integral with said front and back wall, said front wall being curved outwardly and tapering inwardly downwardly, a bottom portion of said front wall being parallel with and opposite a facing bottom portion of said back wall, and said bottom portions having an inter-gripping engagement.

2. The structure of claim 1, including an apertured tab into said rail and extending upwardly between said angled edge portions, and a bottom portion of said tab being slidable upon said plate member.

3. The structure of claim 1, including longitudinal ribs carried by said facing bottom portions of said front and back walls.

* * * * *